United States Patent [19]

Sigelman et al.

[11] Patent Number: 4,691,195

[45] Date of Patent: Sep. 1, 1987

[54] SELF-CONTAINED REFRIGERATOR OPEN DOOR INDICATOR

[75] Inventors: Jesse L. Sigelman, 69 East 71 St., New York, N.Y. 10021; Saul Miodownik, West Hempstead, N.Y.

[73] Assignee: Jesse L. Sigelman, New York, N.Y.

[21] Appl. No.: 705,582

[22] Filed: Feb. 26, 1985

[51] Int. Cl.[4] ..... G08B 13/08

[52] U.S. Cl. ..... 340/545; 62/131; 200/61.62; 340/563; 340/585; 340/658

[58] Field of Search ..... 340/545–546, 340/562, 585, 825.58, 870.25, 563–564, 658; 62/131, 129; 200/61.62, 61.69; 49/13–14; 324/60 C, 61 R; 361/311, 397, 85

[56] References Cited

U.S. PATENT DOCUMENTS 3,986,183 10/1976 Fujiwara ..... 200/61.19 X 4,074,246 2/1978 Conklin et al. ..... 340/545 X 4,241,337 12/1980 Prada ..... 62/131 X 4,463,348 7/1984 Sidebottom ..... 340/585

*Primary Examiner*—Glen R. Swann, III

*Assistant Examiner*—Thomas J. Mullen, Jr.

*Attorney, Agent, or Firm*—Sprung Horn Kramer & Woods

[57] ABSTRACT

A device for indicating that a refrigerator door is open, includes a housing which is mountable on a refrigerator in the vicinity of the refrigerator door during the use of the device. A transducer is mountable at the refrigerator door gasket for changing an electrical parameter in response to the movement of the refrigerator door from its closed position to an open position. Circuitry disposed in the housing senses the change in the electrical parameter of the transducer to produce an alarm after a preselected time delay.

14 Claims, 6 Drawing Figures

SELF-CONTAINED REFRIGERATOR OPEN DOOR INDICATOR

BACKGROUND OF THE INVENTION

The present invention relates to a device for indicating that a refrigerator door is open.

Alarm systems for refrigerators, freezers and the like are known in the prior art as evidenced by U.S. Pat. Nos. 2,553,482; 3,965,465; and 4,463,348, however, all of the known systems involved elaborate devices which operate on house current. These prior art devices are built into refrigerators and thus cannot be used to retrofit existing refrigerators with alarms.

SUMMARY OF THE INVENTION

The main object of the present invention is to provide an inexpensive, compact and self-contained device which can be adapted to use with any existing refrigerator and that will indicate that the refrigerator door is open.

Another object is to provide a device which is battery powered and is sufficiently flexible in design to allow any existing refrigerator to be retrofitted with a door alarm.

These and other objects of the present invention are achieved in accordance with the present invention by a device comprising a housing which is mountable on a refrigerator in the vicinity of its door and that has a transducer which is mountable at the refrigerator door gasket for changing its electrical parameter, preferably its capacitance, in response to the movement of the refrigerator door from its closed position to an open position. Circuitry disposed in the housing senses the change in the electrical parameter and produces an alarm after a preselected time delay.

In accordance with the invention, the circuitry is capable of being adjusted with regard to the delay, for example a delay of 6 mins., 3 mins., $1\frac{1}{2}$ mins. or a "zero" time delay which would act to produce an alarm as soon as the refrigerator door is open.

The circuitry in accordance with the present invention is also capable of being adjusted with regard to its sensitivity, so that it can be adapted to use with virtually any refrigerator.

In a preferred embodiment of the present invention, the transducer comprises a capacitor sensor including two electrically conductive coplanar plates having an insulating base and a dielectric layer thereover with a layer of pressure sensitive adhesive on the base for connecting the base to the refrigerator and the refrigerator gasket so that the plates face the door in use. Where the refrigerator door has no conductor in the vicinity of the coplanar plates, a conductive plate is adhered to the door gasket in alignment with the two coplanar plates when the door is closed.

In a particularly preferred embodiment of the invention the transducer with the coplanar plates is formed by a thin flexible printed circuit so that the conductors from the circuitry in the housing to the coplanar plates are integrally formed with the coplanar plates and have common basis and covering layers. The adhesive layer is also on the base of the conductor so that it stays in place during use. The housing preferably has a storage capability for the conductor so that the conductor can be coiled up inside of the housing and pulled out to obtain the necessary length thereof through an aperture in the housing.

The change in capacitance achieved by the transducer in response to the opening and the closing of the door is sensed by a phase shifting circuit which uses the capacitance of the two coplanar plates to normally maintain two pulse trains out of phase and, upon the opening of the door and the changing of the capacitance of the plates, putting the two plates in phase. A discriminator receives the two pulse trains and produces a signal which is fed to further circuitry which produces an alarm signal at a preselected time delay from the time that the two pulse trains so into phase with one another. The alarm is preferably an audable chirp alarm, although a light or other type of alarm can be used.

These and other features of the present invention will become more apparent from the description of the present invention with reference to the attached drawings, wherein:

DETAILED DESCRIPTION OF THE PREFERRED EMBODIMENTS

Figure 1:
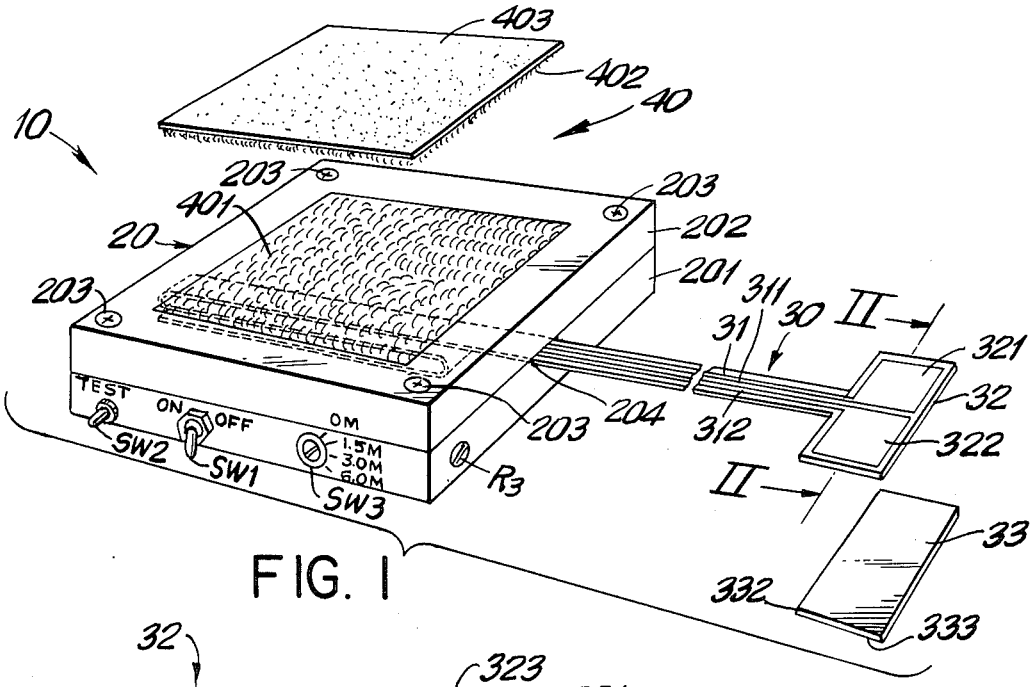
FIG. 1 is a plan view of the device according to the present invention.

Referring now to FIG. 1, the device according to the present invention is shown. The device 10 includes a preferably small, flat housing 20, approximately 2" long by 2" wide by $\frac{1}{2}$" high and including two half portions 201, 202 held together by four screws 203. One side wall further includes an aperture 204 as will be described hereinafter.

The housing 20 is mounted in place by mounting means 40 including mating elements 401 and 402 such coventional means as a Velcro ™ connector. Portion 401 is adhered to housing member 202 and portion 402 has an adhesive surface 403 for placement on the refrigerator body to removably mount the housing 20 in place on the refrigerator as will be shown in FIG. 5.

The housing also has an on/off switch SW1, a test switch SW2, a delay time switch SW3 and a sensitivity adjustment $R_3$. The function of the switches will be shown in more detail with regard to the circuit shown in FIG. 2.

The device also includes transducer 30 including a capacitive sensor 32 and conductors 31 which lead to circuitry in the housing 20. Capacitor sensor 32 includes two coplanar conductive plates 321 and 322. In a particularly preferred embodiment of the present invention, the capacitor sensor 32 and the conductor 31 are all formed from a thin flexible printed circuit with plate 321 intergrally formed with conductor 311 and plate 322 integrally formed with conductor 312.

Figure 2:
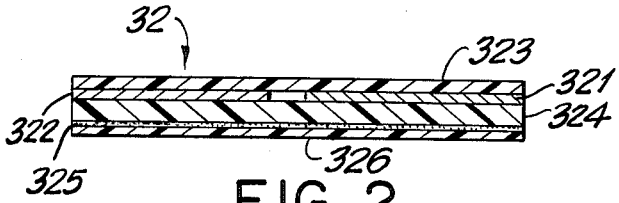
FIG. 2 is a sectional view along line II—II in FIG. 1.

As shown in FIG. 2, the thin flexible printed circuit includes a base layer 324 of insulating material which extends below conductors 311, 312 and a dielectric covering layer 323 which also extends above conductors 311, 312. Dielectric layer 323 is preferably relatively thinner than base layer 324. The flexible printed circuit also preferably includes a pressure sensitive adhesive layer 325 below base layer 324 and a removable paper covering 326 for the pressure adhesive sensitive layer 325.

While the capacitive sensor 32 will operate with most refrigerators which have a sealing gasket on the door and none on the body, if there is a gasket on the body as well and thus no conductor in the vicinity of the sensor when the door is closed, too much sensitivity may be lost. In order to avoid this situation, this device also includes a conductive plate 33 which has a pressure sensitive adhesive layer 332 therebelow and a paper covering layer 333 for adhering to the gasket door in alignment with the capacitive sensor 32 when the door is closed.

Figure 5:
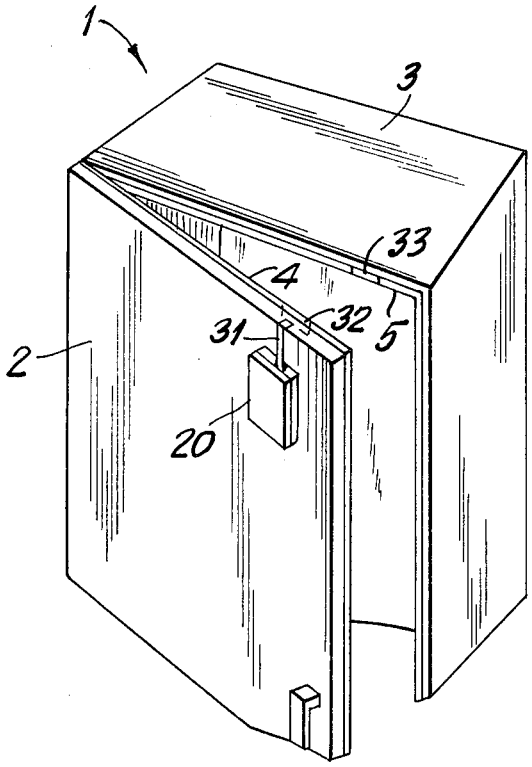
FIG. 5 shows the placement of the device of FIG. 1 on a refrigerator.

FIG. 5 shows the placement of the invention during use. Most refrigerators have a sealing gasket on the door, although it is possible for the gasket to be only on the body or on both the body and the door. With respect to the refrigerator 1 having a body 3 and a door 2, the housing 20 is adhered via the mounting means 40 to the exposed front of the refrigerator door 2. The conductor 31 is adhered along this surface and to the top of the refrigerator door and the capacitive sensor 32 is adhered to the refrigerator door gasket 4. When a gasket 5 is present on the refrigerator body, the plate 33 is adhered to the refrigerator body gasket 4 as shown and in alignment with sensor 32 when door 2 is closed.

Since it might be desirable to mount the device 20 at different locations depending upon the refrigerator or the placement thereof in a kitchen, for example on the bottom of the door, the side of the door near the hinge or on the refrigerator body, the present invention preferably has the ability to provide a variable length conductor 31. This is achieved by coiling up the conductor 31 within the housing 20 and extending a run thereof through aperture 204. If a greater length of conductor 31 is needed, it is merely pulled out of the housing to the extent desired. If subsequently a lesser amount of conductor is needed, the conductor 31 can be pushed back into the housing.

Figure 3:
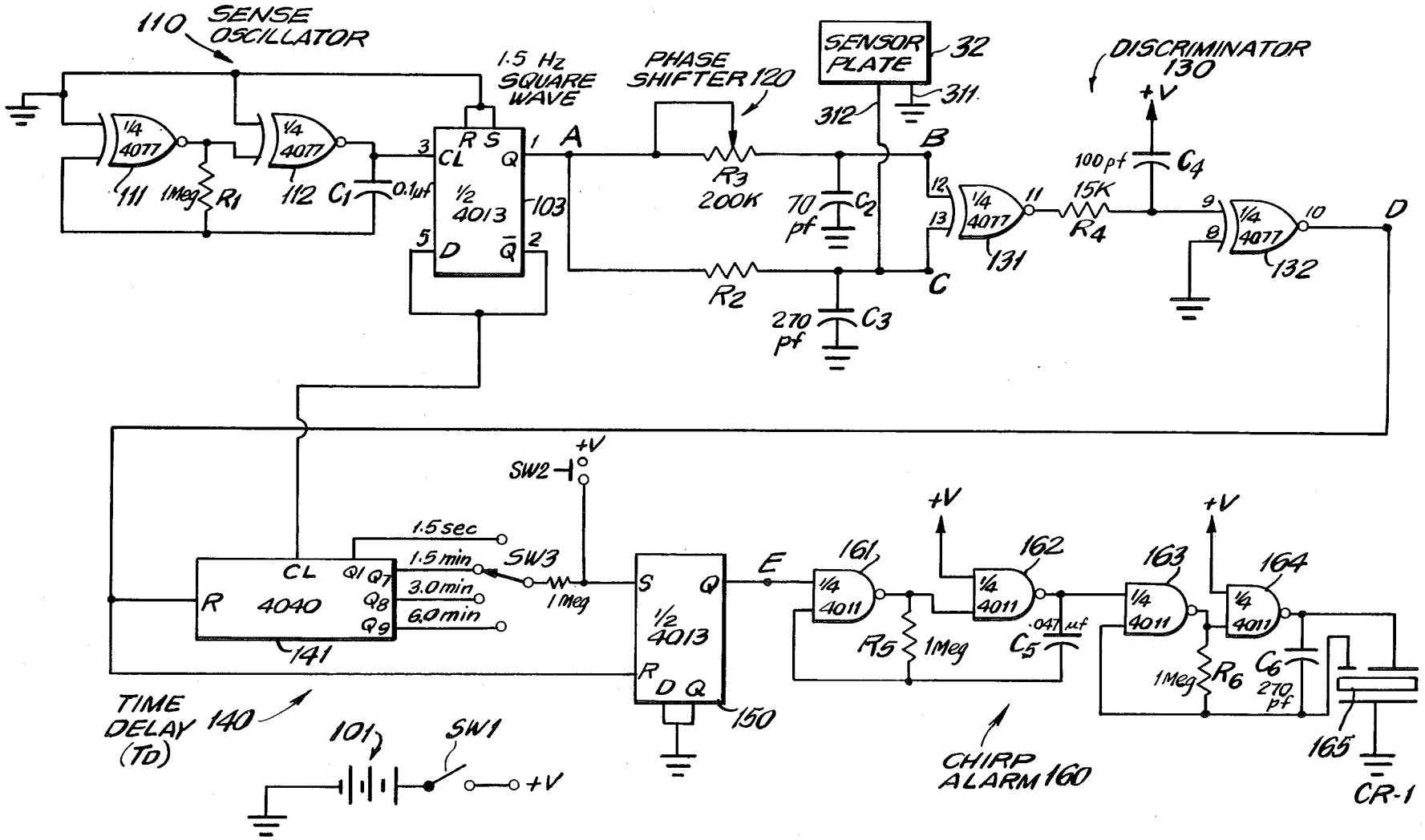
FIG. 3 is a circuit diagram of the circuitry of the device according to the present invention.

FIG. 3 shows the circuitry in accordance with the present invention including the device numbers for the various logic circuits used therein and the values for the various resisters and capacitors.

The circuit is preferably CMOS and thus has a low current drain. The battery 101 is preferably a lithium 3 volt 2320H 110 maH rated battery. With the circuitry used in FIG. 3, the current drain while the door is closed is approximately 3 microamps and the current drain for an activated alarm is approximately 80 microamps. Assuming a 25% usage of the alarm, the battery will last approximately 4 years before needing to be changed.

The battery 101 feeds through on/off switch SW1 to provide +V to all of the circuitry in FIG. 3.

The circuit includes a sense oscillator 110 comprising two feedback connected exclusive NOR gates 111, 112, with resistor $R_1$ a capacitor $C_1$ selected to produce, in conjunction with D type flip-flop 103 a 1–2 Hz, preferably 1.5 Hz, square wave at point A. The waveform for the various points in the circuit of FIG. 3 are shown in the timing diagrams of FIG. 4.

Figure 4:
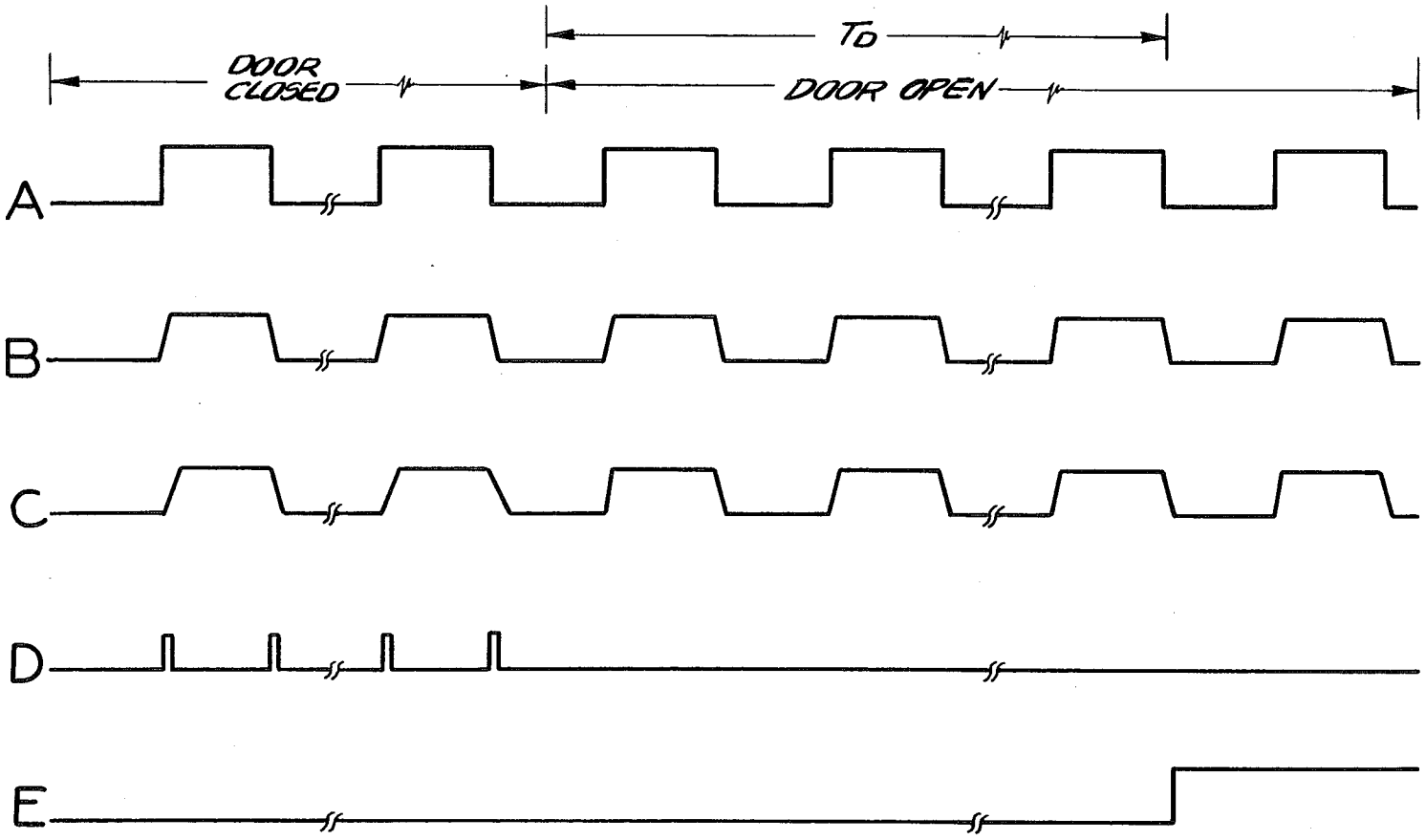
FIG. 4 is a timing diagram at selected points in the circuitry shown in FIG. 3.

The Q output of flip-flop 103, which produces wave form A, is fed to a phase shifter 120. The phase shifter includes two RC circuits which are unbalanced when the door is closed and balanced when the door is open. This is achieved by connecting the capacitors sensor plates 32 in parallel across capacitor $C_3$ so that the value of the combined capacitor is equal to capacitor $C_2$ when the door is open and higher when the door is closed. The sensitivity of the device is set when the door is closed and can be adjusted by means of the variable potentiometer $R_3$ which is used to adjust the effective resistance of the RC network. The two waveforms for B and C which are produced from waveform A upon adjustment of the sensitivity are seen in FIG. 4. During the time when the door is closed, waveforms B and C are out of phase. Upon the opening of the door the waveforms B and C are in phase.

The two waveforms B and C are fed to a discriminator 130 which comprises two exclusive NOR gates 131, 132 connected as shown with appropriate resistor $R_4$ and capacitor $C_4$ to provide waveform D. Waveform D is a series of pulses that are produced as a result in the difference of phase between waveforms B and C and thus are only produced when the door is closed as shown.

The output of discriminator 130 is then fed to a time delay determining circuit 140 which also receives the Q output of flip/flop 103.

The time delay circuit 140 includes a counter 141 which has the Q output of flip-flop 103 at its clock input and the output signal of discriminator 130 at its reset input. As a result, counter 141 is continuously reset as long as discriminator 130 produces the pulses of waveform D.

Upon the opening of the door of the refrigerator, waveforms B and C are in phase due to the change in capacitance and thus the pulses at the output of gate 132 disappear. As a result, counter 141 begins counting. Time delay selector switch SW3 selects one of the outputs of the counter flip/flops, either Ql, Q7, Q8 or Q9 corresponding to a delay of approximately 1.5 seconds, 1.5 minutes, 3 minutes or 6 minutes which corresponds to delay time $T_D$. Thus after the selected time delay $T_D$ a pulse from the output of the selected counter flip flop will set flip flop 150 producing an alarm signal at its Q output corresponding to waveform E. Waveform E is thereafter fed to a chirp alarm circuit 160 including two feedback connected NAND gates 161, 162 and to feedback connected NAND gates 163, 164 with their appropriate resistors $R_5$, $R_6$ and capacitors $C_5$, $C_6$ to produce a 10 Hz chirp signal which is fed to a piezo-acoustic ceramic resonator CR-1 labeled as element 165. Upon wave form E going to a logic 1 as shown in FIG. 4, the chirp alarm will go off until the door is closed and a reset pulse is again produced at point D or counter 141.

The circuitry also includes a test pushbutton SW2 which feeds a positive going pulse to the set input of flip/flop 150 which then acts to produce the logic 1 signal at the Q output thereof which activates the alarm circuit 160 even though the door has not been opened. The alarm is then terminated by activating switch SW1 to the off position and then the on position, which resets the entire circuit. The test switch SW2 is also useful to test the battery and the sensitivity of the phase shifter 120. Specifically, if the switch SW2 is pressed when the door is open, the alarm will sound if the battery is still good. The alarm can be then turned off by the abovementioned procedure. To test the sensitivity, one would press SW2 with the door closed. If the alarm sounded momentarily and then turned off, the sensitivity is correct. If the alarm does not turn off, then the sensitivity must be adjusted until the alarm turns off.

Figure 6:
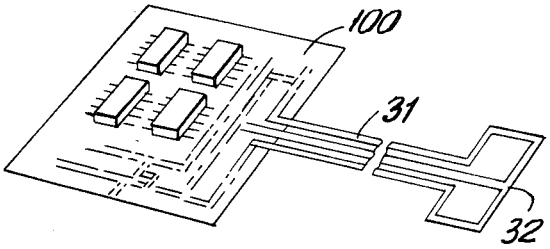
FIG. 6 shows the preferred embodiment of the printed circuit according to the present invention.

As can be seen from the circuitry of FIG. 3, the present invention can be formed from four integrated circuit packages, a ceramic resonator and a number of resistors and capacitors. In a particularly preferred embodiment in the invention, the printed circuit board for these circuit elements is integrally formed with the printed circuit for conductors 31 and capacitive sensor 32 and this circuit board 100 is shown in FIG. 6. This enables the device to be made in an extremely compact manner and at a low manufacturing cost.

It is also apparent that the selection of a 1.5 second delay time $T_D$ is approximately a zero delay and thus will sound an alarm virtually at the same time that the refrigerator door is opened. This enables the device to serve as an aid to dieters.

It will be appreciated that the instant specification and claims are set forth by way of illustration and not limitation, and that various modifications and changes may be made without departing from the spirit and scope of the present invention.

What is claimed is:

1. A device for indicating that a refrigerator door is open, the device comprising:

a housing;

means for mounting the housing on a refrigerator in the vicinity of its door during use;

transducer means mountable at a refrigerator door gasket for changing an electrical parameter in response to the movement of the refrigerator door from its closed position to an open position, wherein the transducer means comprises capacitive sensor means including two electrically conductive coplanar plates having an insulating base and a dielectric layer thereover and adhesive means on the base for connecting the base to a gasket on the refrigerator;

circuit means disposed in the housing for sensing the change in the electrical parameter of the transducer means to produce an alarm after a preselected time delay.

2. The device according to claim 1, wherein the capacitive sensor means further comprises an electrically conductive plate and adhesive means on one side thereof for mounting same on another refrigerator gasket in alignment with the two coplanar plates when the door is closed.

3. The device according to claim 1, wherein the transducer means comprises a thin flexible printed circuit including elongated conductors connecting the two coplanar plates to the circuit means and having an insulating base and cover layer and wherein the two plates and two conductors are all formed by the printed circuit with the base for the plates and conductors being integrally formed and the cover layer for the plates and conductors being integrally formed.

4. The device according the claim 3, wherein the circuit means includes a thin flexible printed circuit in the housing and integrally connected with the printed circuit of the transducer means.

5. The device according to claim 3, wherein the adhesive means comprises an adhesive layer on the base of the flexible printed circuit.

6. The device according to claim 3, wherein the housing comprises a rectangular box including an aperture in a side wall thereof through which the elongated conductors extend and the box is configured to store the conductors in a coiled-up state therein.

7. The device according to claim 1, wherein the circuit means includes means for producing the alarm immediately after the door is opened.

8. The device according to claim 1, wherein the circuit means comprises a battery for energizing same in the housing and wherein the device is self-contained.

9. A device for indicating that a refrigerator door is open, the device comprising:

a housing;

means for mounting the housing on a refrigerator in the vicinity of its door during use;

transducer means mountable at a refrigerator door gasket for changing an electrical parameter in response to the movement of the refrigerator door from its closed position to an open position;

circuit means disposed in the housing for sensing the change in the electrical parameter of the transducer means to produce an alarm after a preselected time delay, and wherein the transducer means comprises a capacitive sensor and wherein the circuit means comprises phase shifting means receptive of a pulse train for splitting same into two out of phase pulse trains and responsive to the capacitance of the sensor to shift the phase of the two out of phase pulse trains into phase when the door is opened.

10. The device according to claim 9, wherein the phase shifting means includes means for adjusting the phase shift of the two pulse trains to adjust the sensitivity of the sensor.

11. The device according to claim 9, wherein the circuit means further comprises discriminating means receptive of the two pulse trains for producing a signal when the two pulse trains are out of phase.

12. The device according to claim 11, wherein the circuit means further comprises means receptive of the signal from the discriminating means for producing an alarm signal at a preselected time delay from the time that the two pulse trains are in phase as long as they remain in phase.

13. The device according to claim 12, wherein the means for producing the alarm signal includes a multiposition selection switch, wherein each position corresponds to a different delay time.

14. The device according to claim 12, wherein the circuit means further comprises means responsive to the alarm signal for producing an audible alarm.

* * * * *